US011926997B2

(12) United States Patent
Dennis

(10) Patent No.: US 11,926,997 B2
(45) Date of Patent: Mar. 12, 2024

(54) LOCKING MECHANISM FOR A WEAR ASSEMBLY

(71) Applicant: TALON ENGINEERING SDN BHD, Perak (MY)

(72) Inventor: Neil Robert Dennis, Sunway (MY)

(73) Assignee: Talon Engineering SDN BHD, Perak (MY)

( * ) Notice: Subject to any disclaimer, the term of this patent is extended or adjusted under 35 U.S.C. 154(b) by 332 days.

(21) Appl. No.: 17/287,005

(22) PCT Filed: Nov. 8, 2019

(86) PCT No.: PCT/AU2019/051234
§ 371 (c)(1),
(2) Date: Apr. 20, 2021

(87) PCT Pub. No.: WO2020/093106
PCT Pub. Date: May 14, 2020

(65) Prior Publication Data

US 2021/0381205 A1 Dec. 9, 2021

(30) Foreign Application Priority Data

Nov. 9, 2018 (AU) ..... 2018904293

(51) Int. Cl.
*E02F 9/28* (2006.01)

(52) U.S. Cl.
CPC ..... *E02F 9/2825* (2013.01); *E02F 9/2833* (2013.01)

(58) Field of Classification Search
CPC ..... E02F 9/2816; E02F 9/2833; E02F 9/2883
See application file for complete search history.

(56) References Cited

U.S. PATENT DOCUMENTS 1,992,591 A 2/1935 Whisler
4,413,432 A * 11/1983 Bierwith ..... E02F 9/2833 37/456
4,433,496 A * 2/1984 Jones ..... E02F 9/2833 37/456
5,052,134 A 10/1991 Bierwith
6,301,810 B1 * 10/2001 Fidler ..... E02F 9/2825 37/458

(Continued)

FOREIGN PATENT DOCUMENTS

WO WO2015/135027 A1 9/2015

OTHER PUBLICATIONS

International Search Report from corresponding International Patent Application No. PCT/AU2019/051234, dated Jan. 17, 2020.

(Continued)

*Primary Examiner* — Gary S Hartmann
(74) *Attorney, Agent, or Firm* — Kusner & Jaffe

(57) ABSTRACT

A wear assembly such as an adapter for a cable shovel having a Whisler-style lip has two legs extending over the lip, and a hole in the legs arranged to align with a hole in the lip. A locking member is inserted in the hole, and hooked around a pivot surface in the lower leg. An actuator is inserted into the hole in the upper leg, and engages with t top end of the locking member. Movement of the actuator causes pivoting of the locking member, and results in the locking member bearing against the lip hole in order to lock the wear assembly in position.

16 Claims, 14 Drawing Sheets

(56) References Cited

U.S. PATENT DOCUMENTS

| | | | | |
|---|---|---|---|---|
| 8,458,931 | B2 * | 6/2013 | Knight | E02F 9/2833 37/456 |
| 8,898,937 | B2 * | 12/2014 | Campomanes | E02F 9/2833 37/456 |
| 9,228,325 | B2 * | 1/2016 | Campomanes | E02F 9/2825 |
| 9,249,558 | B2 * | 2/2016 | Bierwith | E02F 9/2833 |
| 9,816,254 | B2 | 11/2017 | Carpenter et al. | |
| 9,874,001 | B2 * | 1/2018 | Lombardo | E02F 9/2825 |
| 9,920,504 | B2 * | 3/2018 | Bierwith | E02F 9/2891 |
| 10,119,252 | B2 * | 11/2018 | Campomanes | E02F 9/2825 |
| 10,407,880 | B2 * | 9/2019 | Campomanes | E02F 9/2833 |
| 11,286,651 | B2 * | 3/2022 | Rol Corredor | E02F 9/2833 |
| 2005/0011089 | A1 * | 1/2005 | Duke | E02F 9/2833 37/456 |
| 2011/0072693 | A1 | 3/2011 | Knight | |
| 2011/0258891 | A1 | 10/2011 | Ruvang | |
| 2016/0319520 | A1 | 11/2016 | Marchand | |
| 2018/0148908 | A1 | 5/2018 | Johnston et al. | |

OTHER PUBLICATIONS

International-Type Search for Australia Provisional Patent Application No. 2018904293, dated Jul. 30, 2019.

* cited by examiner

LOCKING MECHANISM FOR A WEAR ASSEMBLY

FIELD OF THE INVENTION

The present invention relates to the attachment of a wear member to the digging edge of a shovel, bucket or other excavator. It has particular application in the connection of adapters to an excavator edge. The invention has been developed for use in connection with rope or cable shovels, particularly for the fixing of adapters to Whisler lips such as those manufactured by Komatsu Mining Corporation.

BACKGROUND TO THE INVENTION

The Whisler lip for rope or cable shovel buckets was the subject of U.S. Pat. No. 1,992,591 filed in 1934. It remains the industry standard. A Whisler lip includes mounting points for adapters along its length. Each mounting point is associated with an aperture passing through the lip.

An adapter for a Whisler lip has rearwardly extending bifurcated legs which locate above and below the lip, and which have openings arranged to align with the lip aperture. The adapter is locked into position by means of a locking pin which locates within the aligned adapter openings and lip aperture. Traditionally, the locking pin has incorporated a wedging action which has the ability to tighten the adapter onto the bucket lip.

The forces acting on adapters in use are significant. A typical Whisler lip has a thickness in the order of 170 mm, with the adapter legs each being of a similar thickness, perhaps in the order of 150 mm. An adapter will typically extend about 260 mm along the edge of a bucket lip, and have a length of over 1000 m. A typical adapter weighs in the order of 350 kg.

The dimensions of each lip aperture in a standard Whisler lip are in the order of 8 cm in width and 15 cm in length.

Various proprietary modifications to Whisler lips have been made by manufacturers of adapters. These include the welding of bosses on an inside and/or outside surface of a Whisler lip (fore or aft of the aperture) to engage with complementary surfaces of an adapter. They also include the welding of inserts within the lip aperture to change the size or shape of internal bearing surfaces. One such modification is shown in U.S. Pat. No. 6,986,216 assigned to Esco Corporation.

The preponderance of proprietary systems means that adapters must be made to fit particular makes of bucket lip, rather than being able to be used broadly across a number of bucket lip makes.

The present invention proposes a locking system which has broad application through a number of different lip configurations. Other benefits of the locking system will be detailed in the below description.

SUMMARY OF THE INVENTION

According to one aspect of the present invention there is provided a wear assembly arranged to locate over a lip of a digging apparatus, the lip having a first face and a second face, the lip having an aperture extending between the first face and the second face, the aperture including a bearing surface;

the wear assembly including a wear member having a first leg and a second leg, the first leg having an outer surface arranged to face away from the first face of the lip and an inner surface arranged to face towards the first face of the lip, and a first opening extending between the outer surface of the first leg and the inner surface of the first leg;

the second leg having an outer surface arranged to face away from the second face of the lip and an inner surface arranged to face towards the second face of the lip, and a second opening extending between the outer surface of the second leg and the inner surface of the second leg;

the first opening, the aperture of the lip, and the second opening being arranged when aligned to form a through-hole;

the second opening including a first pivot surface;

the wear assembly including a lock assembly having a locking member and an actuator, the locking member being arranged to locate within the through-hole, the locking member having a second pivot surface at a lower end thereof and a body including a bearing surface;

the actuator being receivable within the first opening;

the second pivot surface being arranged to engage with the first pivot surface to allow pivoting of the locking member about the first pivot surface;

the actuator being operable to cause said pivoting, and to selectively cause the bearing surface of the locking member to bear against the bearing surface of the aperture and thus restrain disengagement of the wear assembly from the lip.

According to a second aspect of the present invention there is provided a locking member for a digging edge wear assembly, the locking member having a first end arranged to engage with an actuator, a second end including a pivot surface, and a body having a bearing surface, the body being located between the first end and the second end, the bearing surface being convex.

According to a third aspect of the present invention there is provided a lock assembly for a digging edge wear assembly, the lock assembly including a locking member and an actuator, the locking member having a first end arranged to engage with the actuator, a second end including a pivot surface, and a body having a bearing surface, the actuator including an extendible member, whereby extension of the extendible member is arranged to cause pivoting of the lock member about its pivot surface.

According to a fourth aspect of the present invention there is provided a wear member arranged to locate over a lip of a digging apparatus, the lip having a first face and a second face, the lip having an aperture extending between the first face and the second face;

the wear member including a first leg and a second leg, the first leg having an outer surface arranged to face away from the first face of the lip and an inner surface arranged to face towards the first face of the lip, and a first opening extending between the outer surface of the first leg and the inner surface of the first leg;

the second leg having an outer surface arranged to face away from the second face of the lip and an inner surface arranged to face towards the second face of the lip, and a second opening extending between the outer surface of the second leg and the inner surface of the second leg;

the first opening, the aperture of the lip, and the second opening being arranged when aligned to form a through-hole;

the first opening including a bracing surface arranged to engage with a bearing surface of a lock assembly; and the second opening including a pivot surface about which a locking member of the lock assembly can rotate.

According to a fifth aspect of the present invention there is provided a method of fixing a wear assembly over a lip of a digging apparatus, the lip having a first face and a second face, the lip having an aperture extending between the first face and the second face, the aperture including a bearing surface;

the wear assembly including a wear member having a first leg and a second leg, the first leg having an outer surface arranged to face away from the first face of the lip and an inner surface arranged to face towards the first face of the lip, and a first opening extending between the outer surface of the first leg and the inner surface of the first leg;

the second leg having an outer surface arranged to face away from the second face of the lip and an inner surface arranged to face towards the second face of the lip, and a second opening extending between the outer surface of the second leg and the inner surface of the second leg;

the second opening including a first pivot surface;

the wear assembly including a lock assembly having a locking member and an actuator, the locking member having a second pivot surface at a lower end thereof and a body including a bearing surface;

the method including the steps of:

(a) locating the wear member on the lip such that the first opening, the aperture of the lip, and the second opening are aligned to form a through-hole;

(b) locating the locking member within the through-hole;

(c) locating the actuator within the first opening;

(d) engaging the second pivot surface with the first pivot surface to allow pivoting of the locking member about the first pivot surface;

(e) operating the actuator to pivot the locking member about the first pivot surface and to cause the bearing surface of the locking member to bear against the bearing surface of the aperture and thus restrain disengagement of the wear assembly from the lip.

It is preferred that the wear member is an adapter, and most preferably a Whisler-style adapter. The digging apparatus may be a rope shovel or cable shovel, most preferably with a Whisler-style lip.

The digging edge wear assembly defines a longitudinal direction of travel of the wear assembly over a bucket lip, a through-hole direction perpendicular to a plane of the bucket surface, and a transverse direction generally parallel to the bucket lip.

It is preferred that the body of the locking member has two bearing surfaces, a first bearing surface on a first side of the locking member and a second bearing surface on a second side of the locking member, the first bearing surface being curved more than the second bearing surface. In other words, the average radius of curvature of the first bearing surface is preferably less than that of the second bearing surface. The first and second sides of the locking member are preferably spaced apart in the direction of travel, that is, in the longitudinal direction.

The locking member may have two pivot surfaces at its second end, one directed to a first side of the locking member and one directed to a second side of the locking member.

The pivot surface(s) of the locking member is preferably located on a pivot projection(s), the or each pivot projection being perpendicular to a line passing from the first end of the locking member to the second end of the locking member.

Each pivot projection preferably includes a bearing surface oriented in the transverse direction.

The first end of the locking member may have an engaging portion arranged to engage with the actuator. The engaging portion may be generally elongate, and oriented in the transverse direction. It is preferred that the engaging portion extends further in the transverse direction than the body of the locking member.

In a preferred embodiment, the engaging portion has a central locating portion and outer drive portions. The central locating portion may have a smaller diameter than the outer drive portions.

The first opening, within the first leg, preferably includes a bracing surface arranged to engage with the actuator. The bracing surface is preferably facing in the longitudinal direction, although it is envisaged that the bracing surface may be slightly inclined towards the through-hole direction, up to about 45° but preferably about 30°. The bracing surface may include a tool receiving aperture. Preferably, the bracing surface is annular.

The first opening preferably includes locking member supporting surfaces. The locking member supporting surfaces are preferably located on either transverse side of the first opening. The locking member supporting surfaces preferably extend inwardly of side walls of the first opening. In the preferred embodiment, the outer drive portions of the engaging portion of the locking member are arranged, in use, to locate atop the locking member supporting surfaces.

The actuator preferably has a first bearing surface arranged to engage with the locking member and a second bearing surface arranged to engage with the bracing of the first opening. The actuator may have an extendible member, such that extension of the extendible member alters the distance between the first bearing surface of the actuator and the second bearing surface of the actuator.

The extendible member may be formed by an externally threaded adjustment bolt located within an internally threaded barrel nut. In a preferred embodiment, the barrel nut has an outer head which forms the second bearing surface of the actuator. The adjustment bolt has an inner end arranged to locate within a body of the actuator. It is preferred that the adjustment bolt is restricted from rotation relative to the body of the actuator. In a preferred embodiment, this is achieved by the use of a holding pin which passes through the body of the actuator and a corresponding aperture in an outer end of the adjustment bolt. Preferably, the pin is oriented in the transverse direction.

The extendible member may include a biasing element such as a compression spring to restrict inadvertent loosening of the extendible member.

The first bearing surface of the actuator is preferably a central hook arranged to locate about the central locating portion of the engaging portion of the locking member.

It is preferred that the actuator be arranged to pivot about the engaging portion of the locking member between an active position wherein the second bearing surface of the actuator is opposed to the bracing surface of the first opening, and an installation position wherein the second bearing surface of the actuator is oriented towards the outer surface of the first leg.

The actuator may have two lower locating surfaces located on transversely opposed sides of the actuator. The lower locating surfaces may be arranged, in use, to engage with locking member supporting surfaces of the first opening.

It is preferred that the actuator is moveable within the first opening between an extended position wherein the first bearing surface and the second bearing surface of the actuator are both bearing against respective mating surfaces and the actuator is in compression, a neutral position wherein the first and second bearing surfaces of the actuator are oriented towards their respective mating surfaces but wherein the actuator is not load bearing, and an insert position whereby the actuator is rotated relative to the first opening.

The arrangement may be such that the first opening and the actuator are shaped so that the actuator can be removed from the first opening in the through-hole direction when in the insert position, but is restrained from moving in the through-hole direction when in the neutral position.

The pivot surface in the second opening is preferably formed by a transversely extending ridge.

BRIEF DESCRIPTION OF THE DRAWINGS

It will be convenient to further describe the invention with reference to preferred embodiments of the present invention. Other embodiments are possible, and consequently the particularity of the following discussion is not to be understood as superseding the generality of the preceding description of the invention. In the drawings.

DETAILED DESCRIPTION OF PREFERRED EMBODIMENTS

Figure 1:
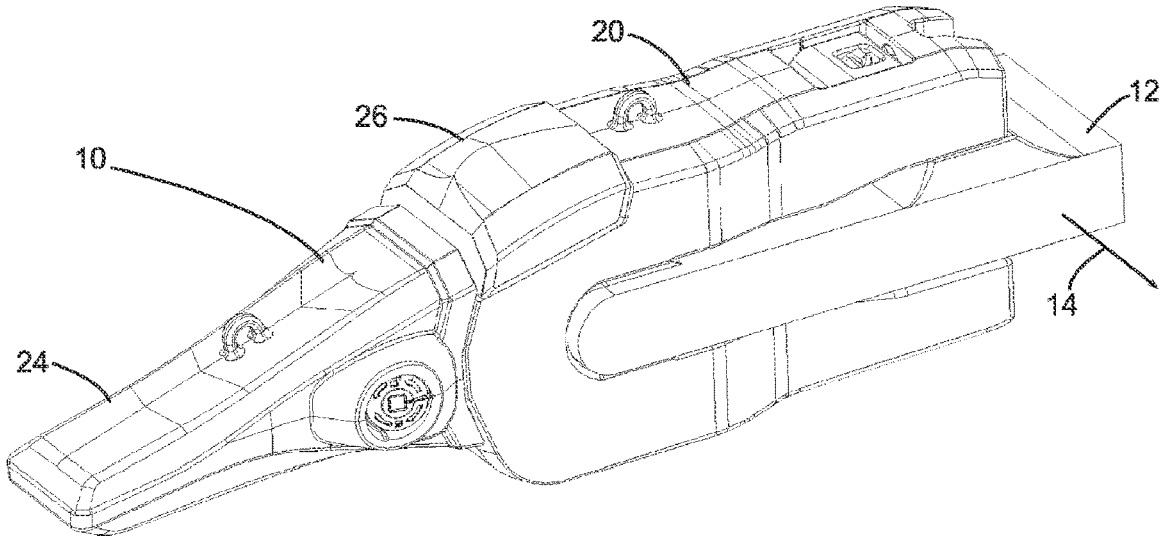
FIG. 1 is a portion of a shovel lip shown with a wear assembly attached.
Figure 2:
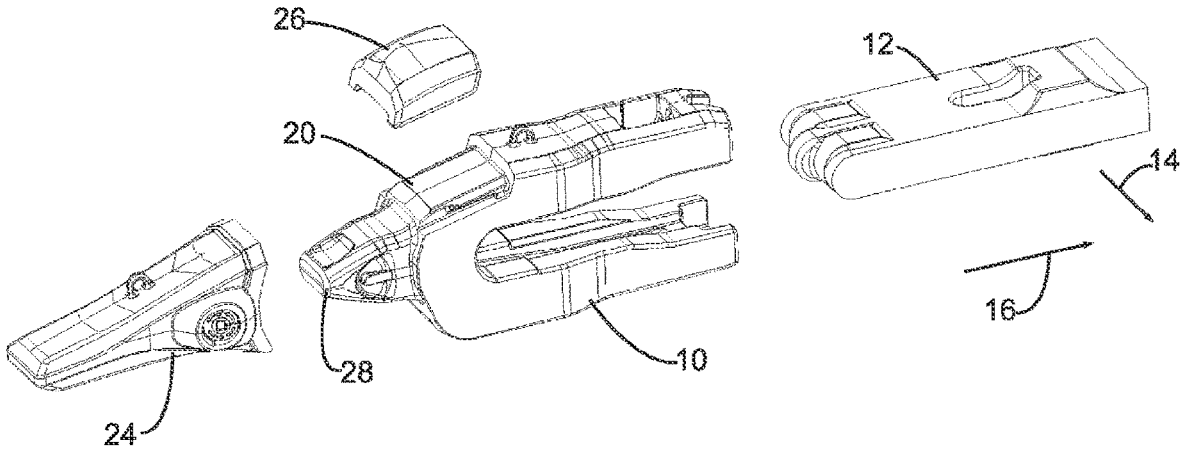
FIG. 2 is the portion of the shovel lip of FIG. 1 shown with an adapter prior to attachment.

Referring to the Figures, FIG. 1 shows a cable shovel lip portion 12 onto which a wear assembly 10 has been mounted. It will be appreciated that a cable shovel lip will extend in a transverse direction 14 on either side of the lip portion 12, with similar wear assemblies 10 arrayed along the extent of the cable shovel lip.

The wear assembly 10 includes an adapter 20, and a lock assembly 22. The wear assembly 10 also includes a wear tooth 24 and shrouds 26 arranged to locate on a nose 28 of the adapter 20. The present disclosure is concerned with the attachment of the adapter 20 onto the lip portion 12, with the wear tooth 24 and shrouds 26 being attached to the adapter 20 by any suitable means.

It will be seen that the adapter 20 is arranged to be moved over the lip portion 12 in a longitudinal direction of travel 16 which is perpendicular to the transverse direction 14.

Figure 3:
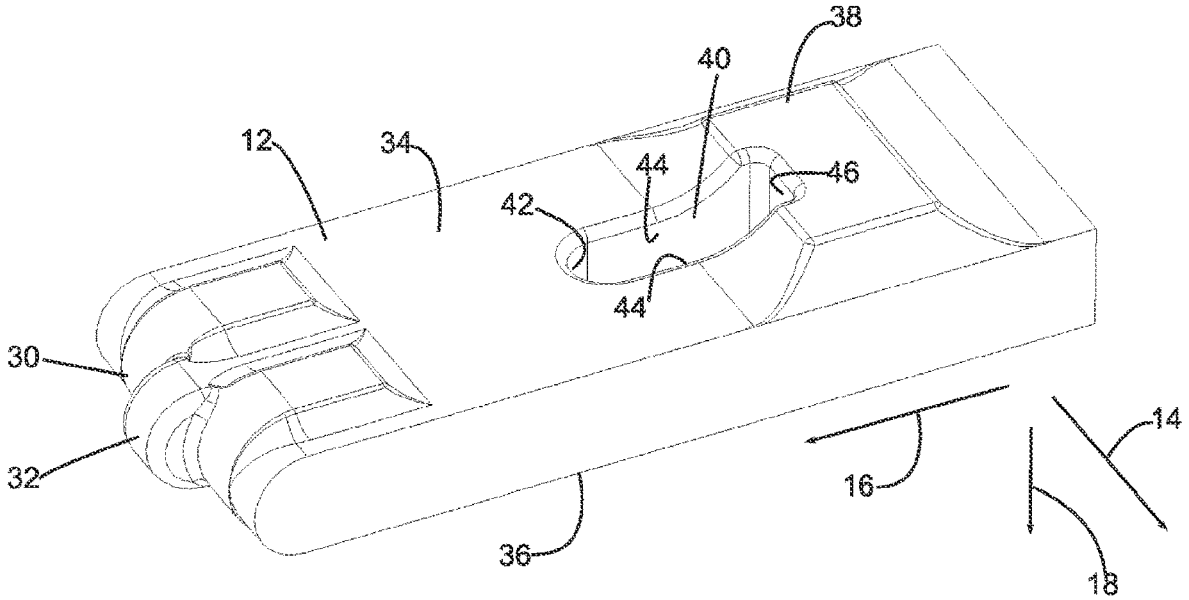
FIG. 3 is a schematic view of the shovel lip portion of FIG. 1.

The lip portion 12 can be seen in more detail in FIG. 3. The lip portion 12 of this embodiment has a front edge 30 which includes a forwardly projecting nose 32. The lip portion 12 has a generally planar first face on an inner side 34 and a generally planar second face on an outer side 36. The lip portion 12 also has a raised boss 38 towards a rear of the inner side 34. There is a similar raised boss (not shown) on the outer side 36.

An aperture 40 extends through the lip portion 12 from the inner side 34 to the outer side 36, in a through-hole direction 18. The aperture 40 has a curved front wall 42, two generally planar side walls 44 and a rear wall 46.

Figure 4:
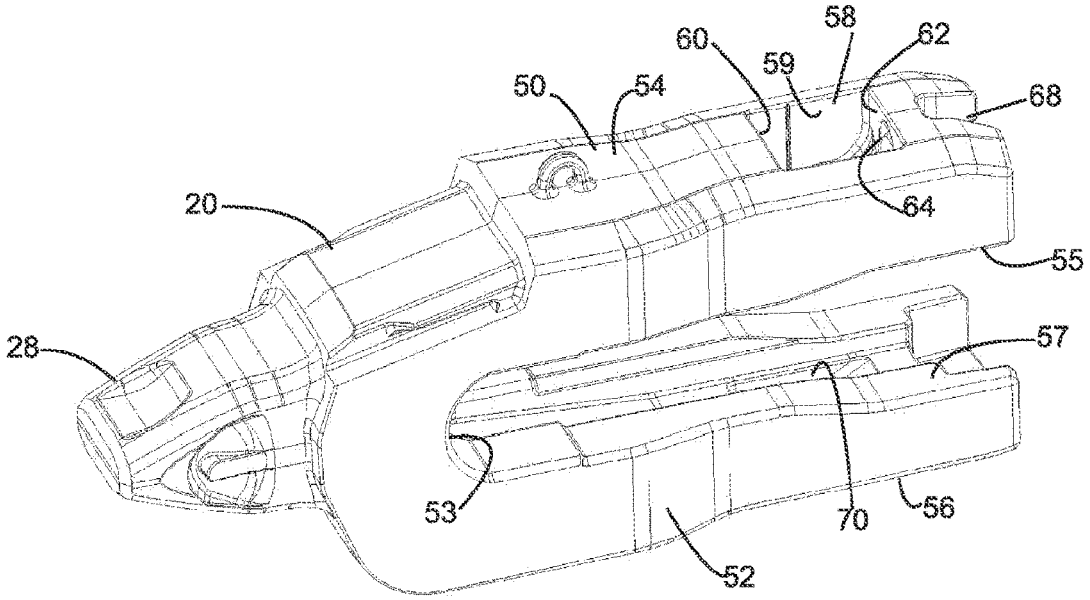
FIG. 4 is a front perspective of an adapter from within the wear assembly of FIG. 1.
Figure 5:
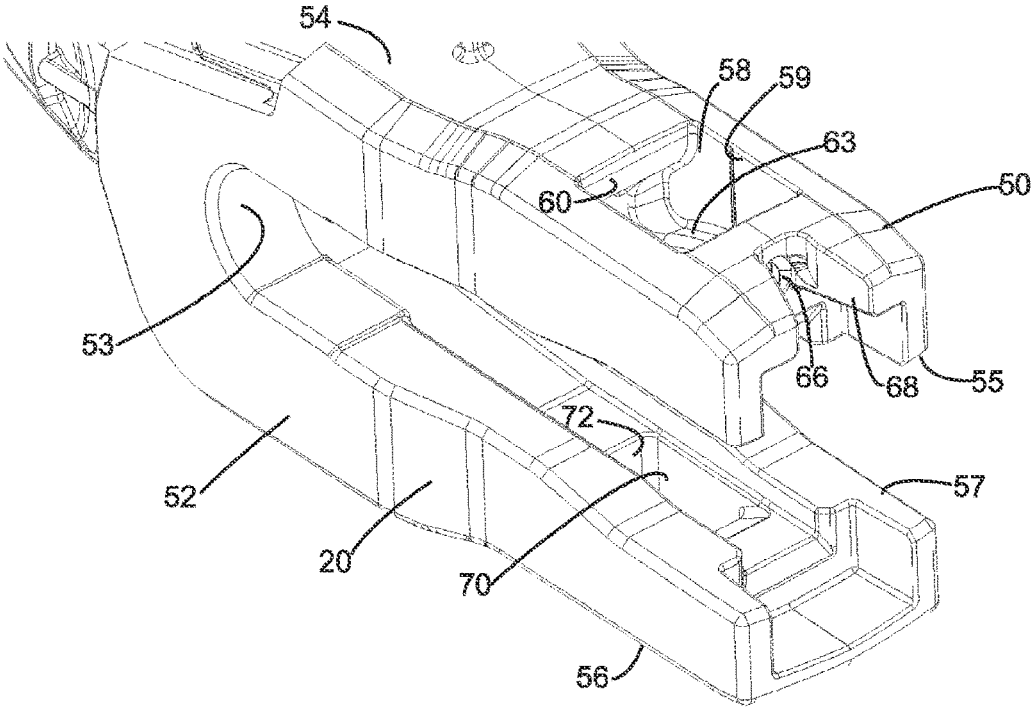
FIG. 5 is a rear perspective of a rear end of the adapter of FIG. 4.
Figure 6:
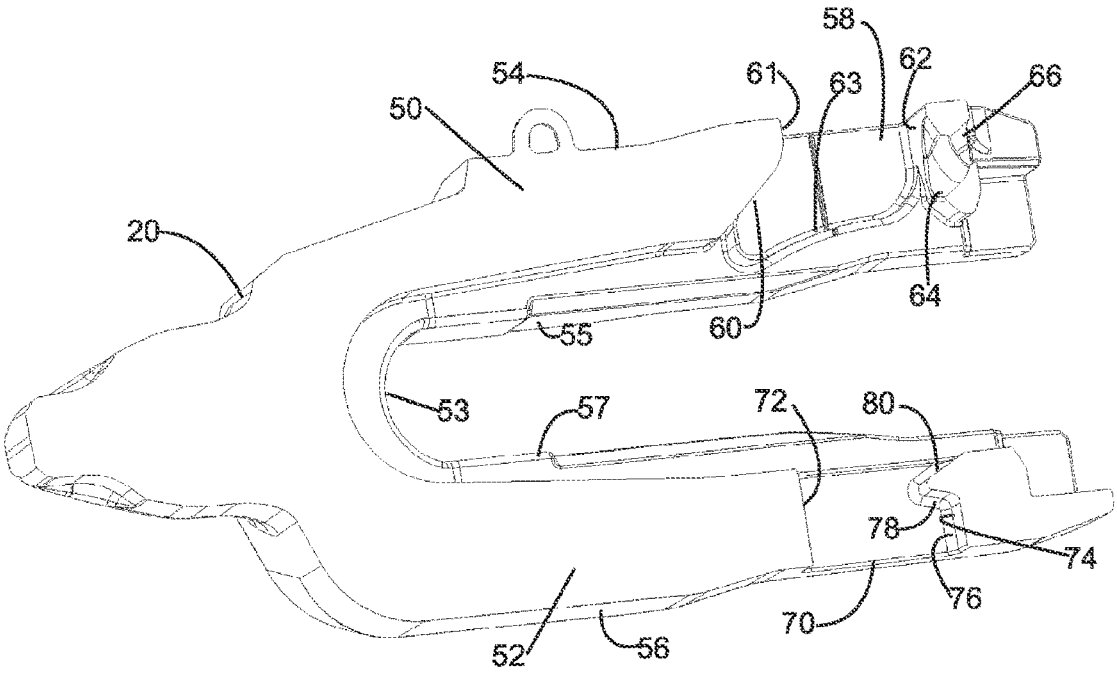
FIG. 6 is a cross section through the adapter of FIG. 4.

The adapter 20 is shown in FIGS. 4 to 6. The adapter 20 has two bifurcated legs extending in the longitudinal direction 16 away from the nose 28: a first leg 50 and a second leg 52. The first leg 50 is arranged to locate against the inner side 34 of the lip portion 12 and the second leg 52 is arranged to locate against the outer side 36 of the lip portion 12. The first and second legs 50, 52 meet at a concave abutment surface 53 located to the rear of the nose 28. The concave abutment surface 53 is complementary in shape to the front edge 30 of the lip portion 12.

The first leg 50 has an outer surface 54 facing away from the inner side 34 of the lip portion 12 and an inner surface 55 arranged to bear against the inner side 34 of the lip portion 12. The second leg 52 has an outer surface 56 facing away from the outer side 36 of the lip portion 12 and an inner surface 57 arranged to bear against the outer side 36 of the lip portion 12.

A first opening 58 extends through the first leg 50 in the through-hole direction 18. The first opening 58 has side walls 59, a front wall 60 and a rear wall 62. The side walls 59 are of a stepped configuration, being relatively spaced apart towards an outer end of the first opening 58 and relatively close together towards an inner end of the first opening 58. This creates a relatively wide outer cavity near the outer surface 54 of the first leg 50 and a relatively thin inner cavity near the inner surface 55 of the first leg 50. The stepped configuration between the inner and outer cavities forms rails 63 oriented generally in the longitudinal direction 16. The rails 63 are convex, curving from the longitudinal direction 16 to about a 30° inclination towards the inner surface 55 as they approach the front wall 60. The rails 63 act as locking member supporting surfaces, as will be described below.

The front wall 60 slopes towards the nose 28 of the adapter 20 as it extends through the first leg 50 towards the inner surface 55. The slope is about 45° relative to the longitudinal and through-hole directions 16, 18. The front wall 60 has an upper portion 61 which curves from the 45° slope to an outermost edge which is aligned in the through-hole direction 18.

The rear wall 62 is generally perpendicular to the outer surface 54. The rear wall 62 has a generally conical recess 64 centrally located, with a receiving aperture 66 extending from the conical recess 64 through the rear wall 62. It will be appreciated that the conical recess 64 forms an annulus around the tool receiving aperture 66. The conical recess 64 and tool receiving aperture 66 are co-axial, with a central axis aligned at about 30° relative to the longitudinal direction 16.

The first leg 50 has a rear alcove 68 at a rear end thereof. The tool receiving aperture 66 passes between the first opening 58 and the rear alcove 68.

A second opening 70 extends through the second leg 52 in the through-hole direction 18. The second opening 70 has generally planar side walls, a generally planar front wall 72, and a rear wall 74.

The rear wall 74 has a lower portion 76 which is generally planar and parallel to the front wall 72. It has a ridge 78 which projects away from the lower portion 76, towards the front wall 72, at an incline of about 15° relative to the longitudinal direction 16. It has an upper portion 80 which extends rearwardly from a front edge of the ridge 78 at an incline of about 45° towards the inner surface 57 of the second leg 52.

The ridge 78 and lower portion 76 combine to form a pivot surface, the function of which will be described below.

Figure 7:
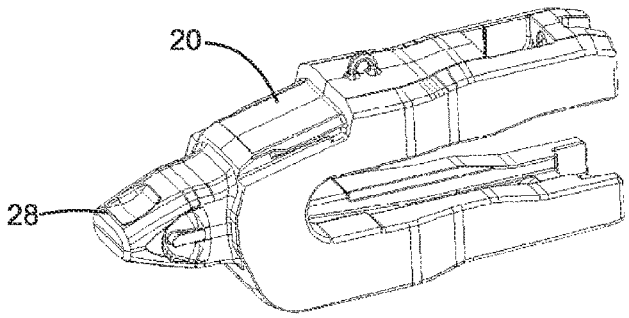
FIG. 7 is an exploded view of the adapter of FIG. 2 and associated lock assembly.
Figure 7:
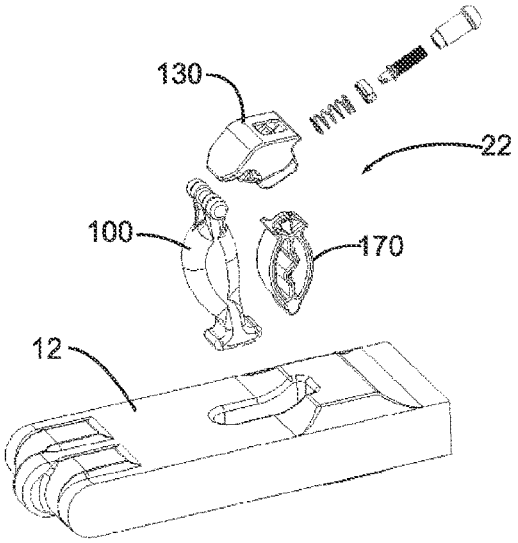

The lock assembly 22 as seen in FIG. 7 has two main components: a locking member 100 and an actuator 130. The lock assembly has an optional third component being a spacer 170.

Figure 8:
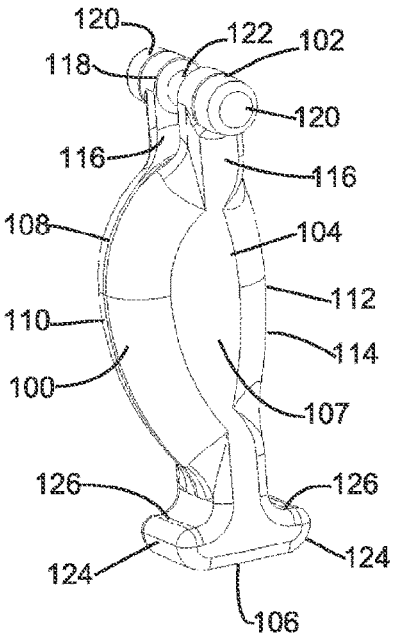
FIG. 8 is a side perspective of a locking member from within the lock assembly of FIG. 7.
Figure 9:
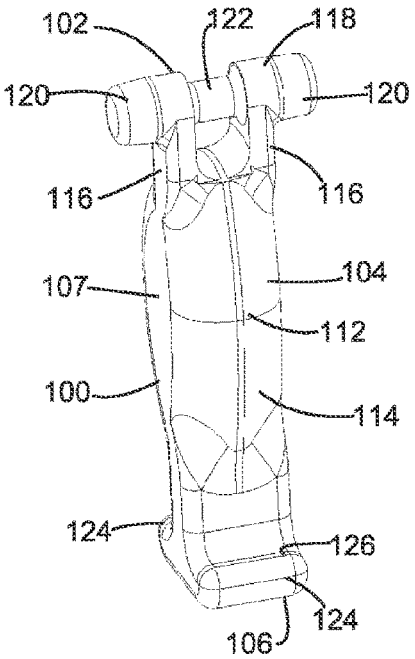
FIG. 9 is a front perspective of the locking member of FIG. 8.

The locking member 100 is shown in FIGS. 8 and 9. The locking member has a first end 102, a body 104, and a second end 106.

The body 104 is generally bulbous in shape. It has two end walls 107 which are generally planar and are arranged, in use, to locate against the side walls 44 of the aperture 40 in the lip portion 12. It has a first side 108 having a convex outer surface which defines a first bearing surface 110 of the body 104, and a second side 112 having a convex outer surface which defines a second bearing surface 114 of the body 104.

The first bearing surface 110 is more curved or bulbous than the second bearing surface 114. In other words, the first bearing surface 110 has a smaller average radius of curvature than the second bearing surface 114, and so extends further from a midline of the body 104.

The first end 102 of the locking member 100 includes two arms 116 which extend from the body 104, and an engaging portion 118 which extends in the transverse direction 14 across the outer ends of the arms 116. The engaging portion 118 has two cylindrical outer drive portions 120 each which extend beyond a respective arm 116 in the transverse direction 14, and a central locating portion being an inner cylindrical portion 122 which extends between the arms 116 in the transverse direction 14. The inner cylindrical portion 122 has a smaller diameter than the outer drive portions 120.

The arrangement is such that the arms 116 are sized to locate within the inner cavity of the first opening 58 in the adapter 20, with the outer drive portions 120 resting on the rails 63 and being too wide to enter the inner cavity. In this way the rails 63 support the locking member 100.

The second end 106 of the locking member 100 includes two pivot projections formed as feet 124. Each foot 124 extends in a lateral direction from an outer end of the body 104, towards the first side 108 and the second side 112 respectively. The feet 124 each have a pivot surface being a concave upper surface 126 which is of constant cross sectional shape in the transverse direction 14.

Figure 10:
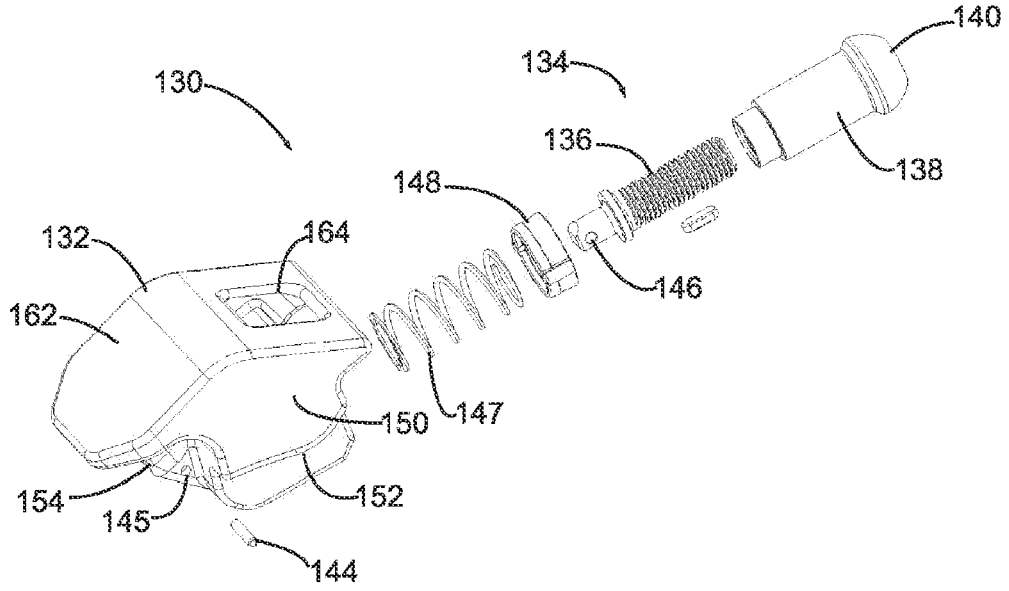
FIG. 10 is an exploded view of an actuator from within the lock assembly of FIG. 7.
Figure 11:
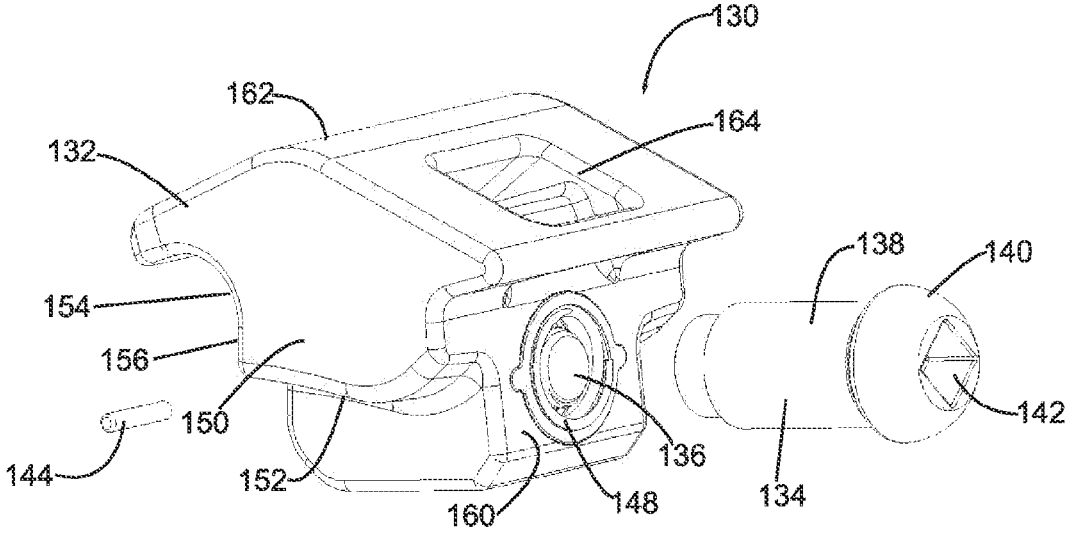
FIG. 11 is a rear view of the actuator of FIG. 10, shown partially assembled.
Figure 12:
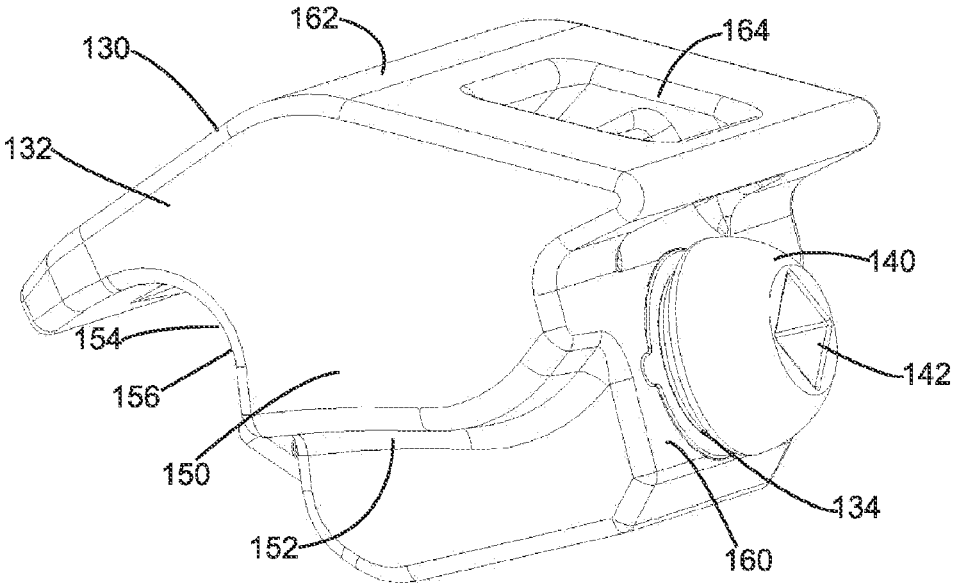
FIG. 12 is a rear perspective of the actuator of FIG. 10, shown assembled.
Figure 13:
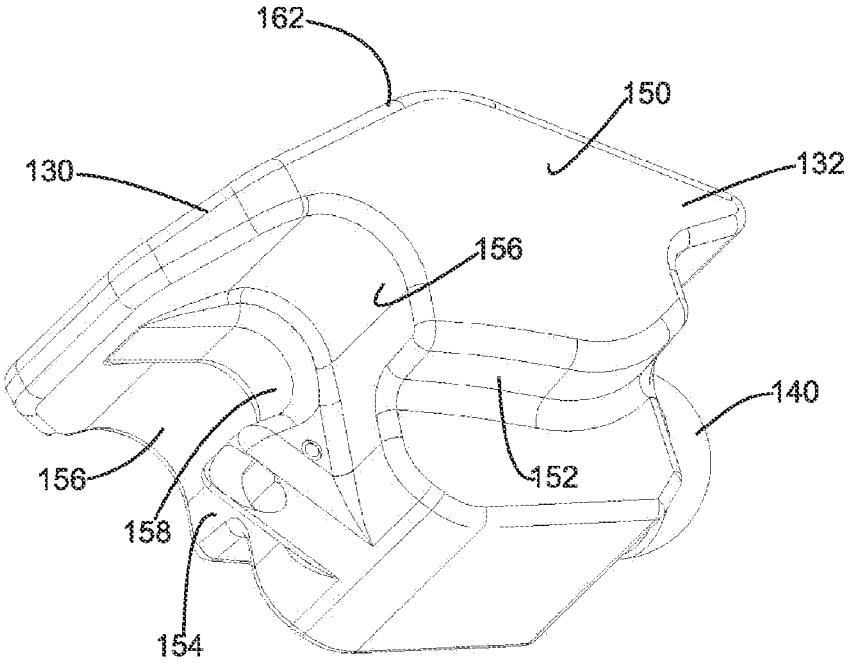
FIG. 13 is a front perspective of the actuator of FIG. 10, shown assembled.
Figure 14:
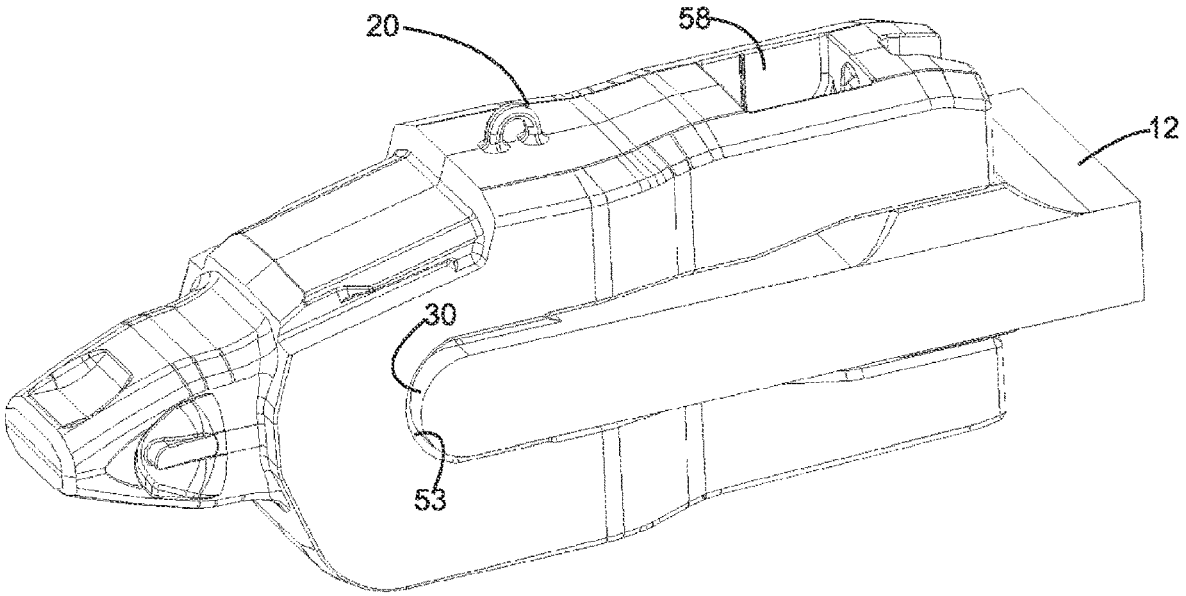
FIG. 14 is the portion of the shovel lip of FIG. 1 shown with the adapter prior to locking.
Figure 15:
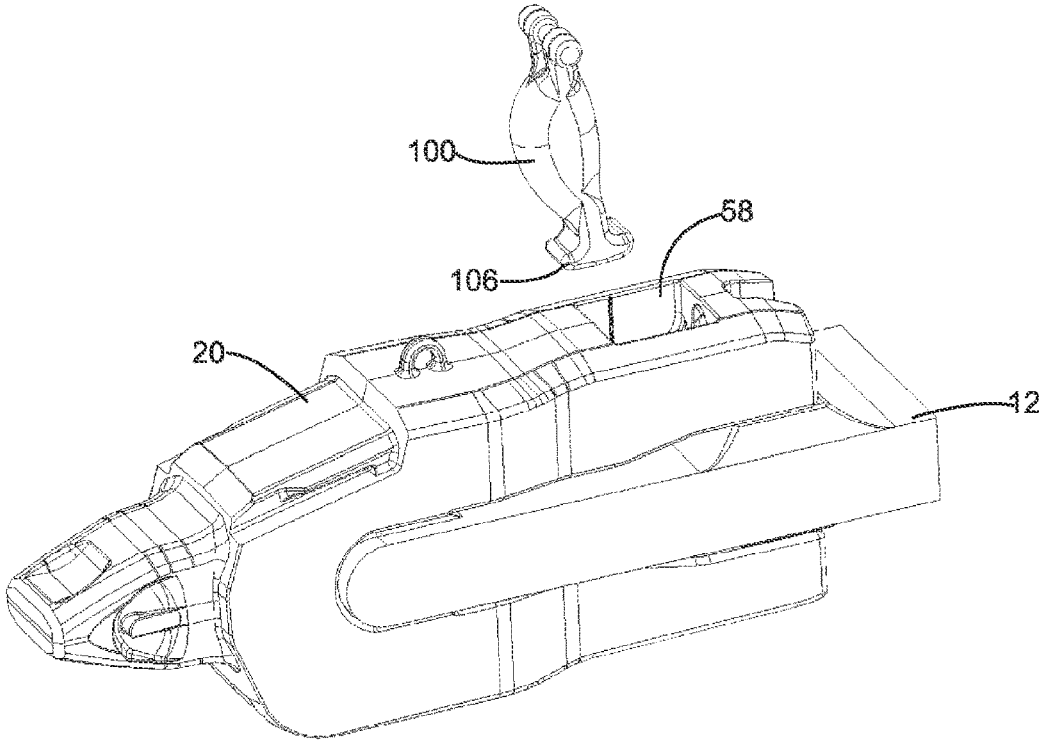
FIG. 15 is the portion of shovel lip and adapter of FIG. 14 showing introduction of the locking member of FIG. 8.
Figure 16:
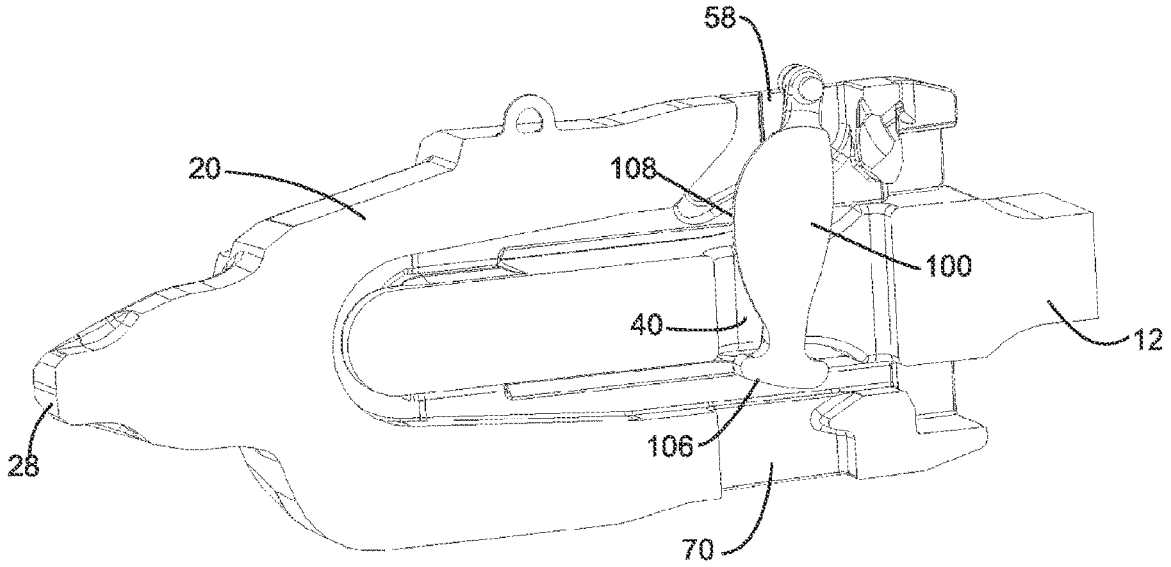
FIGS. 16 to 18 are cross sections through the portion of shovel lip and adapter of FIG. 14 shown sequentially during positioning of the locking member of FIG. 8.

The actuator 130 is shown in an exploded view in FIGS. 10 and 11, and in an assembled view in FIGS. 12 and 13. The actuator 130 has a body 132, and an extendible member 134 formed by an externally threaded adjustment bolt 136 and an internally threaded barrel nut 138. The barrel nut 138 has a bulbous outer head 140 which is shaped so as to abut against the conical recess 64 within the first opening 58 in the first leg 50 of the adapter 20. The outer head 140 has a tool receiving recess 142 centrally located within it, sized to be accessible by a tool passing through the tool receiving aperture 66 from the alcove 68 of the first leg 50.

The body 132 of the actuator 130 has a cylindrical aperture within, arranged to receive the extendible member 134 such that only the outer head 140 protrudes. A pin 144 is arranged to locate within aligned pin receiving apertures 145 in the body 132 and a pin receiving aperture 146 at an end of the adjustment bolt 136 so as to prevent relative rotation of the adjustment bolt 136 and the body 132. In this way, any rotation applied to the tool receiving recess 142 causes the barrel nut 138 to rotate relative to the adjustment bolt 136, causing relative elongate movement along the interlocking threads.

A compression spring 147 and outer engagement ring 148 are located within the cylindrical aperture and arranged to locate about the adjustment bolt 136, such that the outer engagement ring 148 acts against the head 140 of the barrel nut 138 to provide a bias against inward movement of the barrel nut 138 relative to the body 132.

The body 132 of the actuator 130 has two side faces 150 which are each in a stepped configuration, complementary in shape to the first opening 58 in the adapter 20. Each side face has a shoulder 152 which is arranged, in use, to sit on the rails 63 of the first opening 58. The shoulders 152 serve as locating surfaces for the actuator 130

The body 132 of the actuator 130 has a front face 154 including two outer concave sections 156 and an inner concave section 158. The inner concave section 158 projects forward of the outer concave sections 156 and is of a tighter curve. The arrangement is such that the outer concave sections 156 are arranged to engage with the outer drive portions 120 of the locking member 100, while the inner concave section 158 acts as a central hook arranged to engage with the inner cylindrical portion 122 of the locking member 100.

The body 132 of the actuator 130 has a rear face 160 from which the outer head 140 of the barrel nut 138 protrudes.

The body 132 has a gabled cover 162 which extends past both the front face 154 and the rear face 160. The cover 162 has an access hole 164 which assists in removal of the actuator 130 from the assembly when required.

Operation of the wear assembly 10 can be seen in FIGS. 14 to 27.

In the first instance, the adapter 20 is slid onto the lip portion 12 in the longitudinal direction 16 until the front edge 30 abuts the abutment surface 53 of the adapter 20. In this position the first opening 58 of the first leg 50, aperture 40 of the lip portion 12, and the second opening 70 of the second leg 52 align to form a through-hole through the wear assembly.

The locking member 100 can then be lowered into this through-hole from the outside of the first opening 58. The locking member 100 is oriented such that its second end 106 is pointed towards the second opening 70. In the embodiment of the drawings, where the aperture 40 of the lip portion 12 is relatively large, the locking member 100 is oriented with its first side 108 pointed towards the nose 28.

It will be appreciated that the transverse width of the second end 106 and the body 104 of the locking member 100 is smaller than the transverse width of the inner cavity of the first opening 58, thus allowing these parts of the locking member 100 to pass into the aperture 40.

Figure 17:
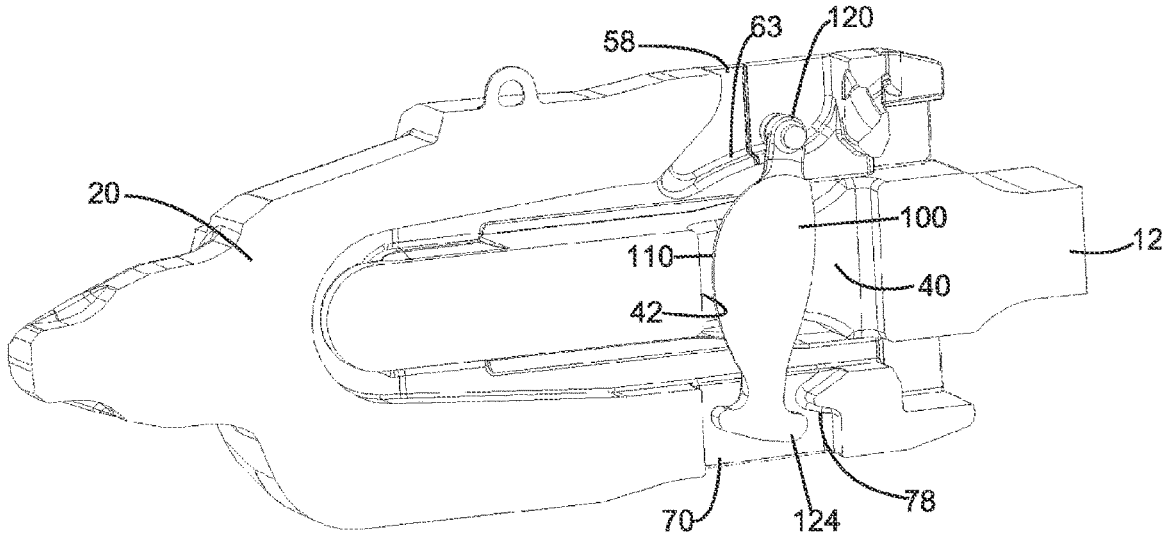
Figure 18:
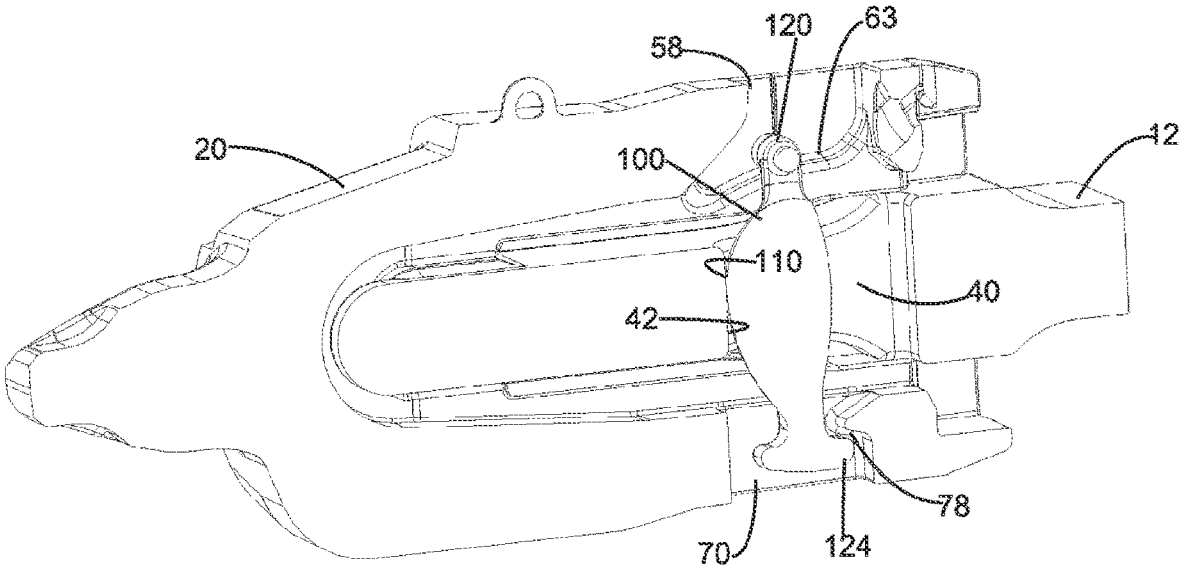
Figure 19:
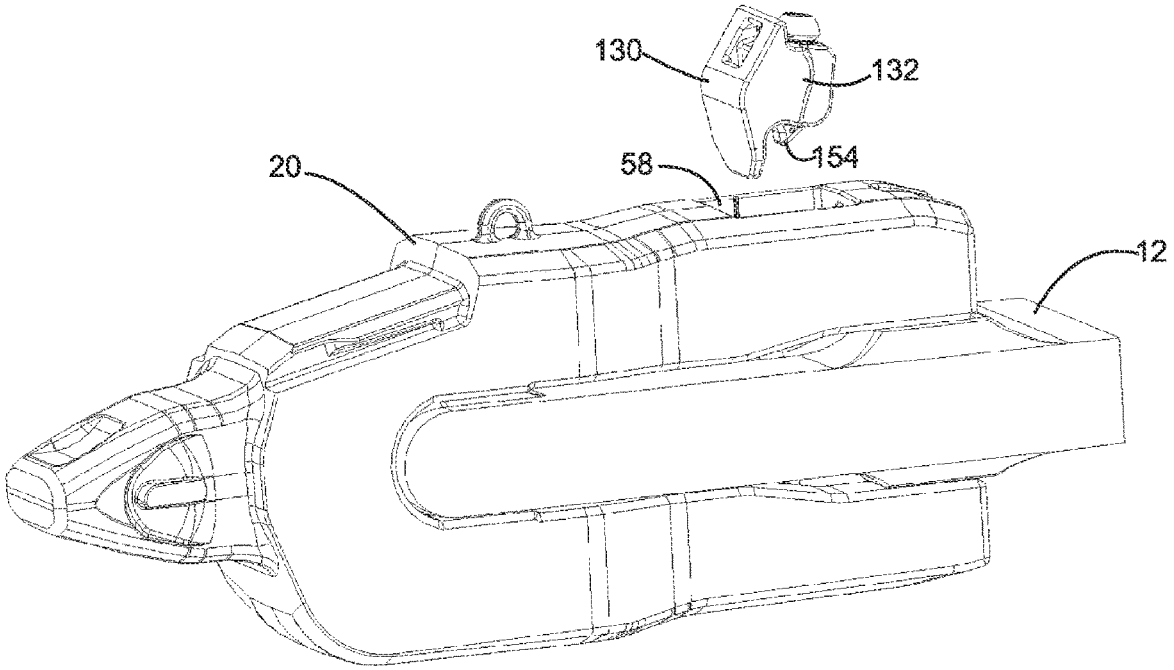
FIG. 19 is the portion of shovel lip and adapter of FIG. 14 showing introduction of the actuator of FIG. 10.
Figure 20:
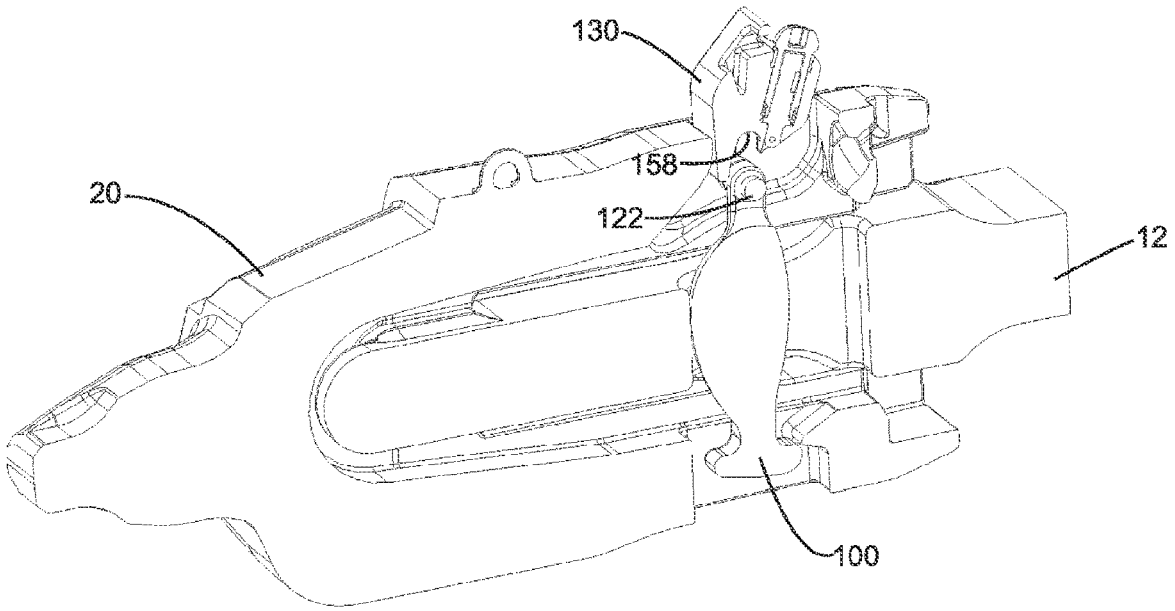
FIGS. 20 to 23 are cross sections through the portion of shovel lip and adapter of FIG. 14 shown sequentially during positioning of the actuator of FIG. 10.
Figure 21:
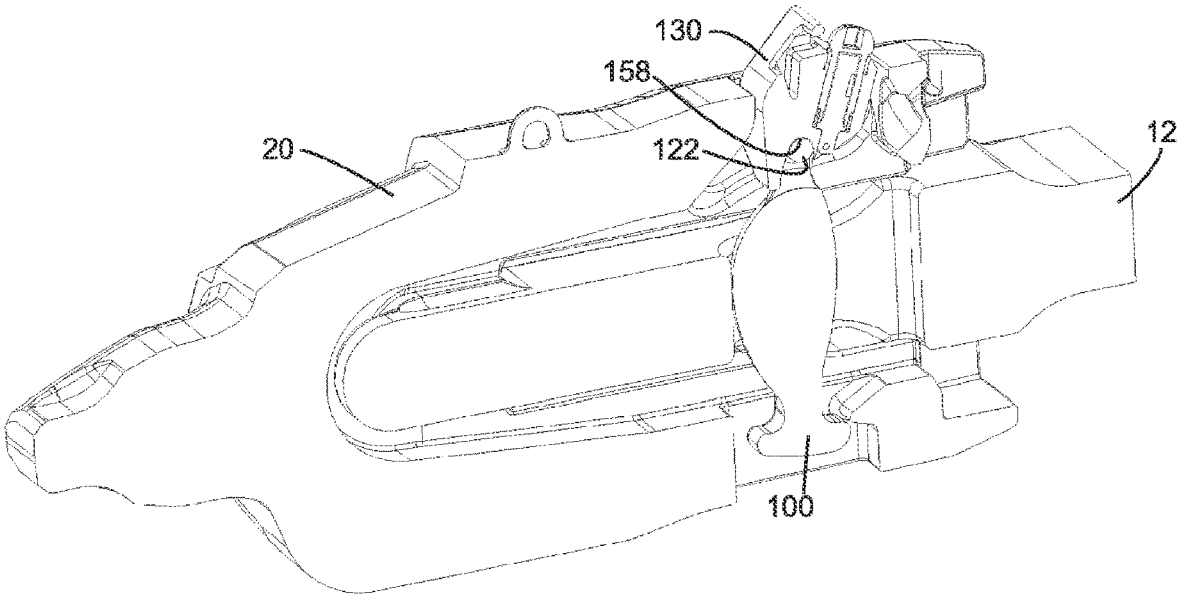
Figure 22:
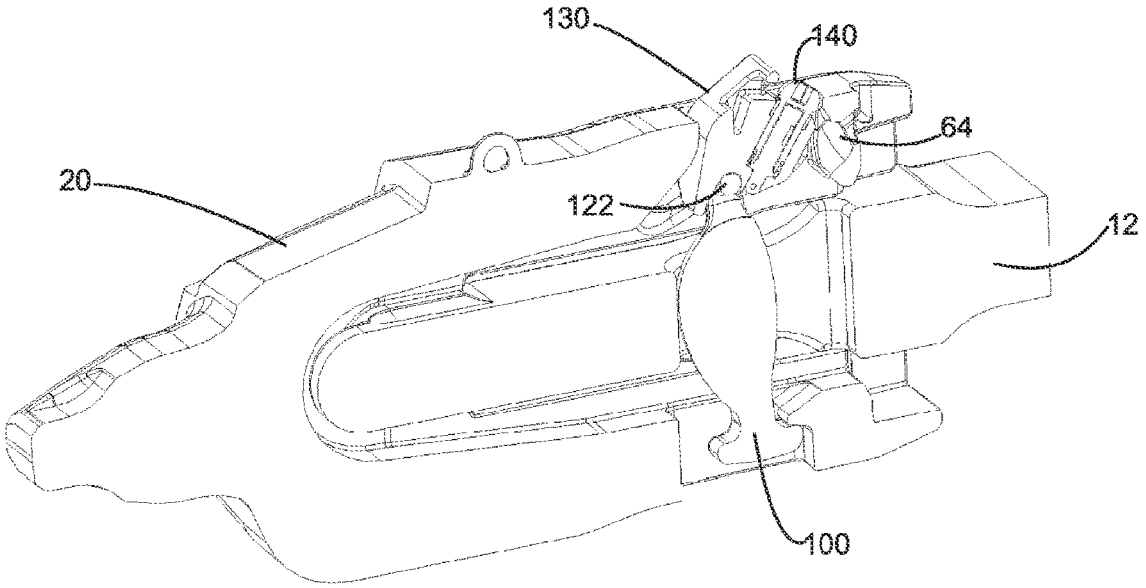
Figure 23:
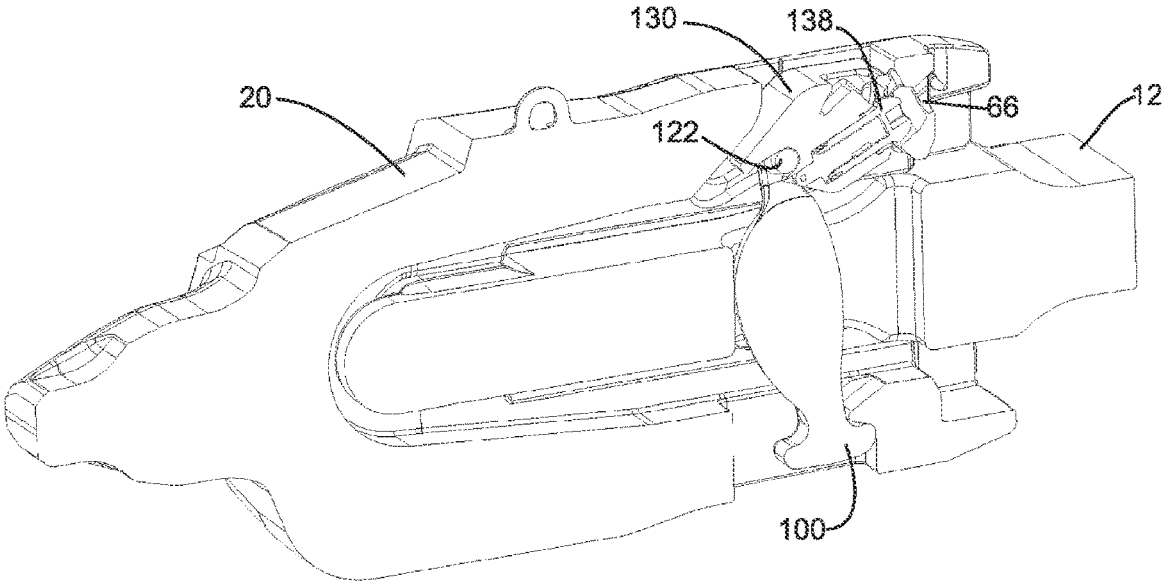
Figure 24:
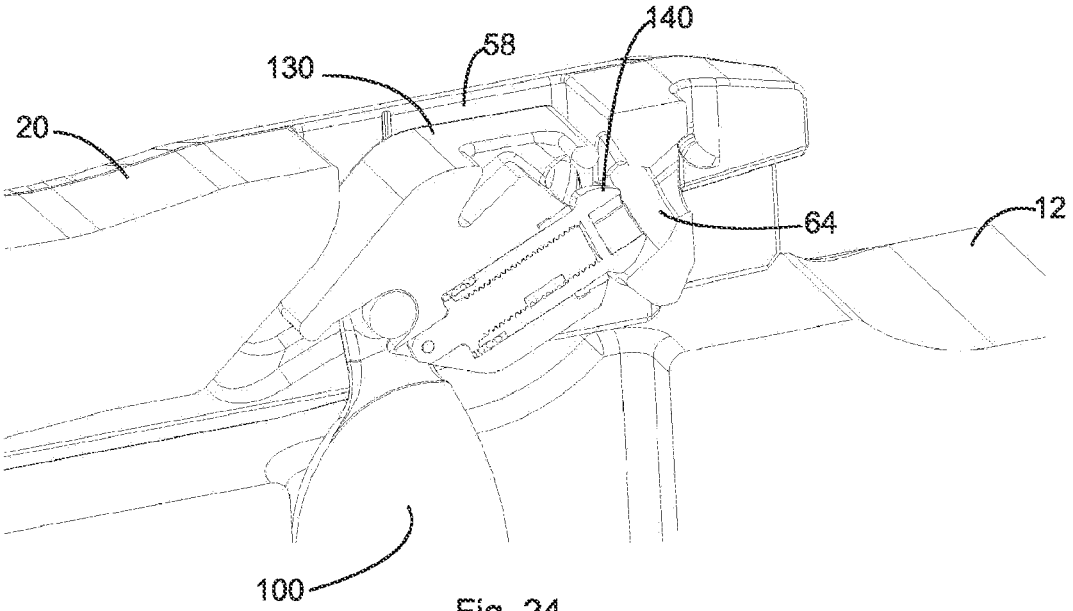
FIGS. 24 to 26 are cross sections through a first opening of the adapter of FIG. 14 shown sequentially during operation of the actuator of FIG. 10.
Figure 25:
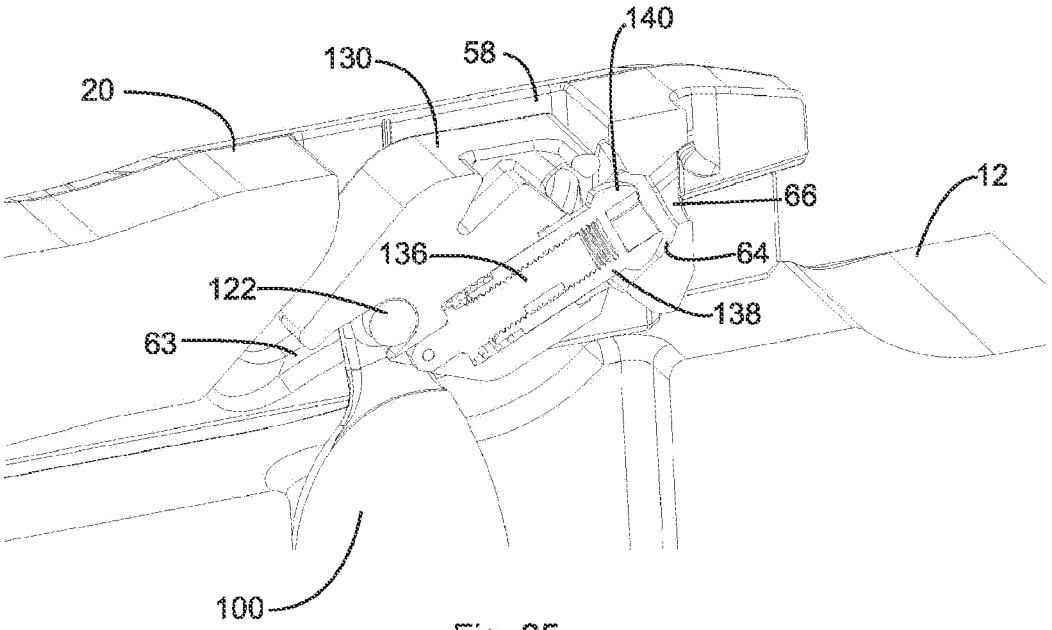

To achieve its final position a foot 124 of the locking member 100 is hooked around the ridge 78 of the second opening 70. The locking member 100 is sized so that this hooked position corresponds with the resting of the outer drive portions 120 on the rails 63 of the first opening 58. This arrangement is shown in FIGS. 17 and 18. It will be appreciated that the locking member 100 can be pivoted about the ridge 78 so that the first bearing surface 110 moves away from the front wall 42 of the aperture 40, but in a rest position the first bearing surface 110 lies against the front wall 42 of the aperture 40.

The actuator 130 can then be brought into position. This is done firstly by orienting the body 132 so that the front face 154 is pointed in the through-hole direction 18, and lowering the body 132 so that the outer concave sections 156 of the front face 154 engage with the outer drive portions 120 at the first end 102 of the locking member 100, and the inner concave section 158 of the front face 154 engages with the inner cylindrical portion 122 at the first end 102 of the locking member 100. This represents an insert position of the actuator 130, shown in FIGS. 20 and 21.

The actuator 130 can then be rotated about the locking member 100 so that it locates entirely within the first opening 58, with the outer head 140 of the barrel nut 138 locating against the conical recess 64 of the first opening 58, and the shoulders 152 of the body portion 132 resting on the rails 63 of the first opening 58. This represents a neutral position of the actuator 130, shown in FIGS. 23 and 24.

The lock assembly 22 can then be activated in order to rigidly lock the adapter 20 to the lip portion 12. This is achieved by the application of a tool through the tool receiving aperture 66 in the first leg 50, which is used to rotate the barrel nut 138 relative to the adjustment bolt 136 to extend the extendible member 134. The outer head 140 of the barrel nut 138 acts as a bearing surface of the lock assembly 22. The conical recess 64 of the adapter 20 acts as a bracing surface against which the outer head 140 of the barrel nut 138 engages. The extendible member 134 is placed in compression, which results in a force being applied by the outer concave sections 156 of the front face 154 of the body 132 to the outer drive portions 120 at the first end 102 of the locking member 100. This force acts as a moment on the locking member 100, causing pivoting of the locking member about the ridge 78 and resulting in a bearing force being applied by the first bearing surface 110 to the front wall 42 of the aperture 40. The front wall 42 thus acts as a bearing surface of the lip portion 12. The first end 102 may travel a short distance along the rails 63 during this tightening.

Figure 26:
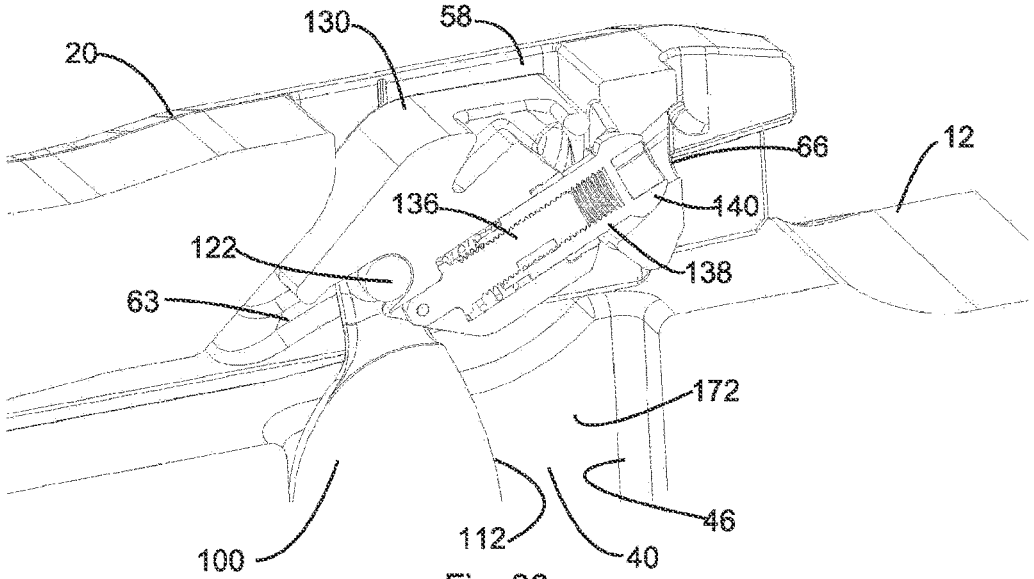
Figure 27:
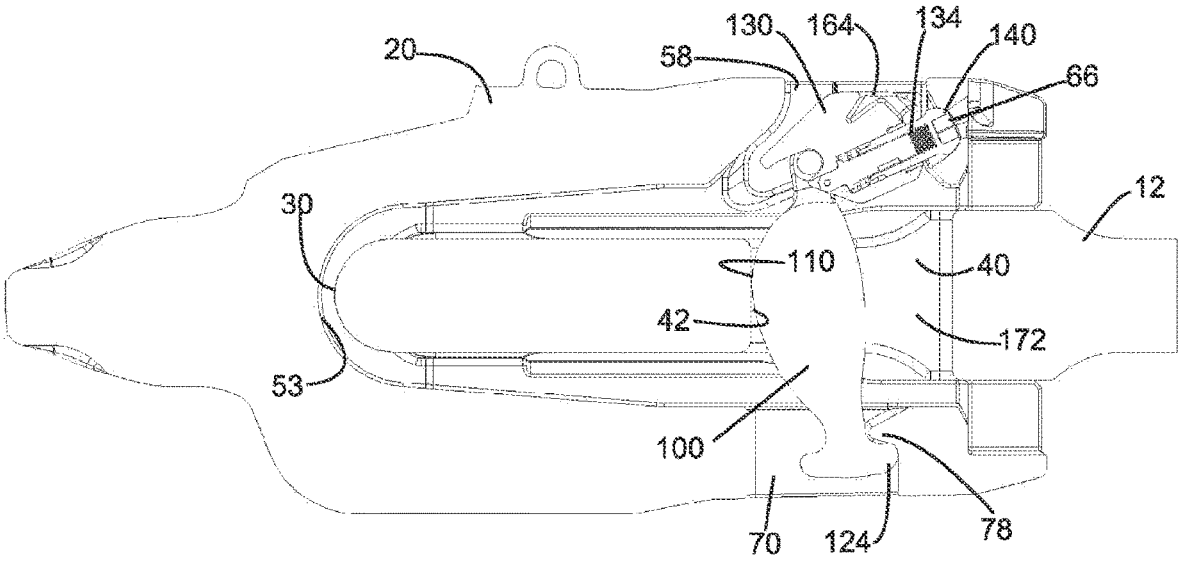
FIG. 27 is a cross section through the portion of shovel lip and adapter of FIG. 14 shown following operation of the actuator of FIG. 10.

The extendible member 134 can be tightened until the adapter 20 is rigidly fixed to the lip portion 12. This represents an extended position of the actuator 130, and is shown in FIGS. 26 and 27. It will be appreciated that should any loosening occur in use, due to wear or vibration, the extendible member 134 can be readily retightened. Such loosening is unlikely, however, due to the biasing action of the spring 147.

In this configuration, upon tightening there is a relatively large empty space 172 remaining between the rear wall 46 of the lip aperture 40 and the second side 112 of the body 104 of the locking member 100. It is proposed that a flexible spacer 170 is introduced along the locking member 100, the flexible spacer being arranged to locate within the empty space 172.

The flexible spacer 170 may be made from a resilient material such as rubber, and acts to plug the empty space 172 and prevent the ingress of fines material.

When the adapter 20 is to be released from the lip portion 12, the extendible member 134 can be loosened back to the neutral position. Using the access hole 164 for grasping, the actuator 130 can be rotated back to the insert position, and readily removed.

It will be appreciated that removal of the actuator 130 leaves a clear space (that is, a space into which fines material has not collected) into which the locking member 100 can be manipulated for easily removal.

Figure 28:
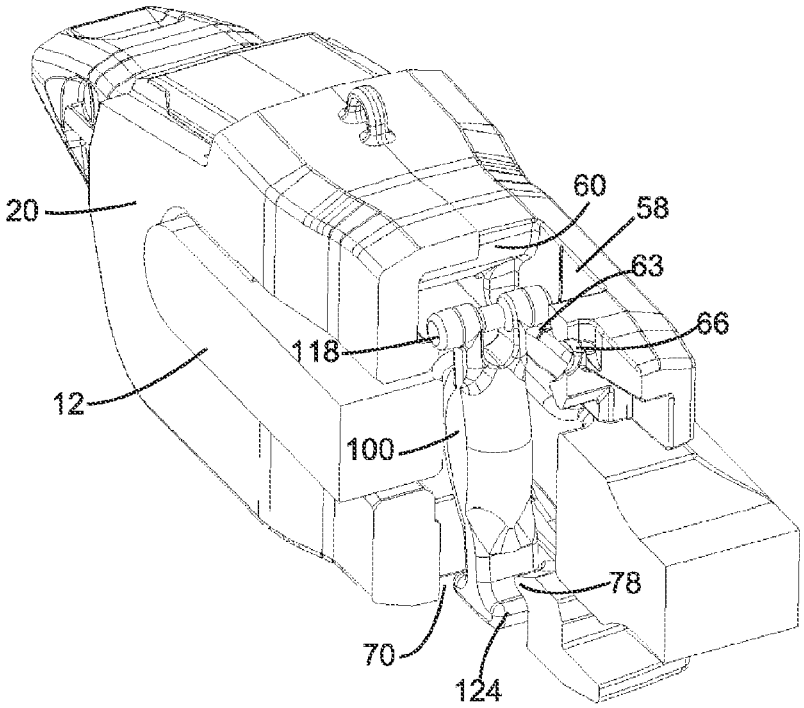
FIG. 28 is a partially cut-away rear view of the portion of shovel lip and adapter of FIG. 14 following installation.
Figure 29:
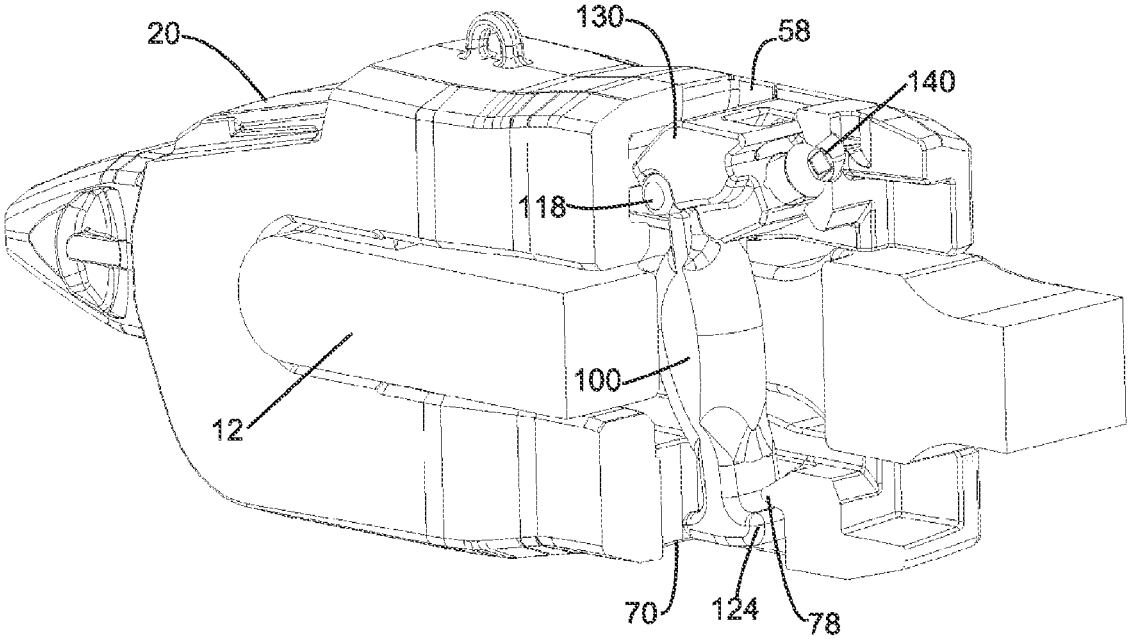
FIG. 29 is a further partially cut-away rear perspective of the portion of shovel lip and adapter of FIG. 14 following installation.

FIGS. 28 and 29 show partially cut-away views of the wear assembly 10 in its tightened configuration. FIG. 28 shows the final position of the locking member 100 with the actuator 130 hidden, while FIG. 29 shows the position of the actuator within the final locked wear assembly.

The wear assembly 10 has been described and shown for use in connecting to a lip portion 12 having relatively large apertures 40. Where the apertures 40 are smaller, for instance due to the presence of an insert welded within them, the locking member 100 can be reversed so that the second side 112 faces towards the nose 28 and the second bearing surface 114 acts against the front wall 42 of the aperture 40. A smaller spacer 170 may optionally be included. In this way, the same wear assembly can be used in conjunction with a variety of lip designs.

Modifications and variations as would be apparent to a skilled addressee are deemed to be within the scope of the present invention.

What is claimed is:

1. A wear assembly arranged to locate over a lip of a digging apparatus, the lip having a first face and a second face, the lip having an aperture extending between the first face and the second face, the aperture including a bearing surface, the wear assembly comprising:

a wear member, comprising:

a first leg, comprising:

an outer surface arranged to face away from the first face of the lip;

an inner surface arranged to face towards the first face of the lip; and a first opening extending between the outer surface of the first leg and the inner surface of the first leg; and a second leg, comprising:

an outer surface arranged to face away from the second face of the lip;

an inner surface arranged to face towards the second face of the lip; and a second opening extending between the outer surface of the second leg and the inner surface of the second leg, the second opening including a first pivot surface;

a lock assembly, comprising:

a locking member arranged to locate within a through-hole formed when the first opening, the aperture of the lip, and the second opening are aligned, the locking member comprising:

a first end;

a second end having a second pivot surface arranged to engage with the first pivot surface to allow pivoting of the locking member about the first pivot surface; and a body including a locking member bearing surface; and an actuator receivable within the first opening, the actuator being operable to cause said pivoting and selectively cause the locking member bearing surface to bear against the aperture bearing surface and thus restrain disengagement of the wear assembly from the lip, the actuator comprising:

a first bearing surface acting against the first leg; and a front face acting against the first end of the locking member.

2. A wear assembly as claimed in claim 1; wherein the wear member is an adapter.

3. A wear assembly as claimed in claim 1, wherein the second pivot surface is located on pivot projections, the pivot projections being perpendicular to a line passing from the first end of the locking member to the second end of the locking member.

4. A wear assembly as claimed in claim 1, wherein an upper end of the locking member has an engaging portion arranged to engage with the actuator.

5. A wear assembly as claimed in claim 1, wherein the first opening, within the first leg, includes a bracing surface arranged to engage with the actuator.

6. A wear assembly as claimed in claim 5, wherein the actuator further comprises a second bearing surface arranged to engage with the locking member, and wherein the first bearing surface is arranged to engage with the bracing surface of the first opening.

7. A wear assembly as claimed in claim 6, wherein the actuator has an extendible member, such that extension of the extendible member alters a distance between the first bearing surface of the actuator and the second bearing surface of the actuator.

8. A wear assembly as claimed in claim 1, wherein the actuator is moveable within the first opening between an extended position wherein the first bearing surface and the second bearing surface of the actuator are both bearing against respective mating surfaces and the actuator is in compression, a neutral position wherein the first and second bearing surfaces of the actuator are oriented towards their respective mating surfaces and the actuator is not load bearing, and an insert position whereby the actuator is rotated relative to the first opening.

9. A wear assembly as claimed in claim 1, wherein the first opening includes locking member supporting surfaces located on either transverse side of the first opening.

10. A wear assembly as claimed in claim 9, wherein an upper end of the locking member has an engaging portion arranged to engage with the actuator, the engaging portion having a central locating portion and outer drive portions, the outer drive portions being arranged, in use, to locate atop the locking member supporting surfaces.

11. A wear member arranged to locate over a lip of a digging apparatus, the lip having a first face and a second face, the lip having an aperture extending between the first face and the second face, the wear member comprising:

a first leg, comprising:

an outer surface arranged to face away from the first face of the lip;

an inner surface arranged to face towards the first face of the lip; and a first opening extending between the outer surface of the first leg and the inner surface of the first leg, the first opening comprising:

a bracing surface arranged to engage with a bearing surface of a lock assembly; and side walls having a stepped configuration so as to form rails on which a portion of the lock assembly can be received;

a second leg, comprising:

an outer surface arranged to face away from the second face of the lip;

an inner surface arranged to face towards the second face of the lip; and a second opening extending between the outer surface of the second leg and the inner surface of the second leg, the second opening comprising a pivot surface about which a locking member of the lock assembly can rotate, wherein the first opening, the aperture of the lip, and the second opening are arranged when aligned to form a through-hole.

12. A wear member as claimed in claim 11, wherein the wear member is an adapter.

13. A wear member as claimed in claim 11, wherein the bracing surface is facing within 45° of a longitudinal direction.

14. A wear member as claimed in claim 11, wherein the pivot surface in the second opening is formed by a transversely extending ridge.

15. A wear member as claimed in claim 11, wherein the first opening includes locking member supporting surfaces boated on either transverse side of the first opening.

16. A method of fixing a wear assembly over a lip of a digging apparatus, the lip having a first face and a second face, the lip having an aperture extending between the first face and the second face, the aperture including a bearing surface, the wear assembly including a wear member having a first leg and a second leg, the first leg having an outer surface arranged to face away from the first face of the lip and an inner surface arranged to face towards the first face of the lip, and a first opening extending between the outer surface of the first leg and the inner surface of the first leg the second leg having an outer surface arranged to face away from the second face of the lip and an inner surface arranged to face towards the second face of the lip, and a second opening extending between the outer surface of the second leg and the inner surface of the second leg, the second opening including a first pivot surface, the wear assembly including a lock assembly having a locking member and an actuator, the locking member having a first end, a second end, a second pivot surface at the second end, and a body including a locking member bearing surface, the actuator having a front face and a first bearing surface, the method comprising:

(a) locating the wear member on the lip such that the first opening, the aperture of the lip, and the second opening are aligned to form a through-hole;

(b) locating the locking member within the through-hole;

(c) locating the actuator within the first opening;

(d) engaging the second pivot surface with the first pivot surface to allow pivoting of the locking member about the first pivot surface; and (e) operating the actuator such that the front face of the actuator acts against the first end of the locking member and the first bearing surface acts against the first leg to pivot the locking member about the first pivot surface and to cause the locking member bearing surface to bear against the aperture bearing surface and thus restrain disengagement of the wear assembly from the lip.

* * * * *